US012435628B2

(12) United States Patent
Narhi et al.

(10) Patent No.: US 12,435,628 B2
(45) Date of Patent: Oct. 7, 2025

(54) PROPPED FRACTURE DIMENSION DETERMINATION BASED ON PARENT/CHILD WELL INTERACTIONS

(71) Applicant: ExxonMobil Technology and Engineering Company, Spring, TX (US)

(72) Inventors: Ward E. Narhi, Kingwood, TX (US); Holger A. Meier, Montgomery, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 0 days.

(21) Appl. No.: 18/402,341

(22) Filed: Jan. 2, 2024

(65) Prior Publication Data

US 2024/0240556 A1 Jul. 18, 2024

Related U.S. Application Data

(60) Provisional application No. 63/480,379, filed on Jan. 18, 2023.

(51) Int. Cl.

| | |
|---|---|
| ***E21B 49/00*** | (2006.01) |
| ***E21B 43/26*** | (2006.01) |
| ***E21B 47/12*** | (2012.01) |

(52) U.S. Cl.

CPC ..... *E21B 49/00* (2013.01); *E21B 2200/20* (2020.05)

(58) Field of Classification Search

CPC ..... E21B 43/267; E21B 43/26; E21B 49/00; E21B 47/00; E21B 43/2607; E21B 2200/20

See application file for complete search history.

(56) References Cited

U.S. PATENT DOCUMENTS

| | | | | |
|---|---|---|---|---|
| 2019/0026409 | A1* | 1/2019 | Coenen | G01V 20/00 |
| 2021/0040841 | A1* | 2/2021 | Dusterhoft | G01V 1/226 |
| 2022/0098963 | A1* | 3/2022 | Shetty | E21B 49/008 |

* cited by examiner

*Primary Examiner* — Zakiya W Bates

(74) *Attorney, Agent, or Firm* — ExxonMobil Technology and Engineering Company—Law Department

(57) ABSTRACT

A method for determining propped fracture dimensions for a parent well includes hydraulic fracturing a stage of a child well to form a child well fracture, as well as, during the hydraulic fracturing process, measuring, via the parent well, data that are indicative of the formation of a hydraulic connection between the wells via interaction between the wetted front of the child well fracture and the propped region of a corresponding parent well fracture. The method includes measuring TFR (or VFR) data corresponding to the formation of the hydraulic connection between the two wells. The method includes estimating a child well fracture dimension when the hydraulic connection was formed using the TFR data, in combination with a fracture growth profile, and estimating a propped fracture dimension of the parent well fracture based on the estimated dimension of the child well fracture and the distance between the wells at that stage.

9 Claims, 10 Drawing Sheets

400

PROPPED FRACTURE DIMENSION DETERMINATION BASED ON PARENT/CHILD WELL INTERACTIONS

CROSS-REFERENCE TO RELATED APPLICATION

This application claims priority to and the benefit of U.S. Provisional Application No. 63/480,379, entitled "Propped Fracture Dimension Determination based on Parent/Child Well Interactions," having a filing date of Jan. 18, 2023, the disclosure of which is incorporated herein by reference in its entirety.

FIELD OF THE INVENTION

The techniques described herein relate generally to the field of hydrocarbon well completions and hydraulic fracturing operations. More specifically, the techniques described herein relate to determining propped fracture dimensions for a parent well based on interactions between the parent well and a child well that is in the vicinity of the parent well.

BACKGROUND OF THE INVENTION

This section is intended to introduce various aspects of the art, which may be associated with embodiments of the present techniques. This discussion is believed to assist in providing a framework to facilitate a better understanding of particular aspects of the present techniques. Accordingly, it should be understood that this section should be read in this light, and not necessarily as admissions of prior art.

Low-permeability hydrocarbon reservoirs are often stimulated using hydraulic fracturing techniques. Hydraulic fracturing consists of injecting a volume of fracturing fluid through created perforations and into the surrounding reservoir at such high pressures and rates that the reservoir rock in proximity to the perforations cracks open and created fractures extend outwardly in proportion to the injected fluid volume. This results in the creation of hydraulic fractures that propagate both horizontally and vertically within the formation and are often abstracted as ellipses with a length and a height.

Once the fracturing fluid has created the hydraulic fractures within the reservoir, proppant is typically pumped into the hydraulic fractures. The proppant travels with the pumped fracturing fluid and is governed by the physics of particle transport. When the pumps are turned off, the hydraulic fractures lose hydraulic pressure due to leak-off and then close. However, the regions of the hydraulic fractures that include proppant are held open mechanically by the presence of the proppant. In this regard, the term "wetted fracture" (or, alternatively, the term "wetted region") refers to the entire hydraulic fracture, while the term "propped fracture" (or, alternatively, the term "propped region") refers to the region of the hydraulic fracture where proppant is present in enough quantity to prevent the closure of the hydraulic fracture.

In this manner, the hydraulic fractures serve to increase the fluid permeability within the reservoir, thus permitting hydrocarbon fluids to flow into the wellbore and then be produced at the surface. In operation, the success of the hydraulic fracturing process has a direct impact on the production characteristics of the hydrocarbon well. In particular, the dimensions of the resulting hydraulic fractures directly affect the amount of hydrocarbon fluids that may be recovered from the reservoir. To that end, techniques have been developed to indirectly estimate such information. However, such techniques generally do not differentiate between the entire wetted fractures and the propped fractures. This is an issue since, in general, the productivity of the corresponding well is defined by the propped regions of the hydraulic fractures, with the remainder of the wetted regions of such hydraulic fractures not contributing strongly to production. Therefore, knowledge of the wetted fracture dimensions is not sufficient to predict well performance and/or to guide well spacing, stacking, and/or completion strategies during development planning.

Moreover, while a few techniques have been developed to provide some information regarding propped fracture dimensions, such techniques are limited in value due to their high costs, low accuracy levels, and associated constraints. For example, while some techniques provide for the inference of propped fracture lengths for a well based on pressure data and/or fiber data measured with respect to such well, such techniques utilize data that are limited in scope and must be measured after the well is put on production. As a result, the obtained information is not highly useful.

SUMMARY OF THE INVENTION

An embodiment described herein provides a method for determining propped fracture dimensions for a parent well. The method includes hydraulic fracturing a stage of a child well to form a child well fracture extending into a surrounding formation, as well as, during the hydraulic fracturing of the stage of the child well, measuring, via a parent well, data that are indicative of the formation of a hydraulic connection between the child well and the parent well via an interaction between the wetted front of the child well fracture and the propped region of a corresponding parent well fracture. The method also includes measuring time to first response (TFR) data and/or volume to first response (VFR) data corresponding to the formation of the hydraulic connection between the child well and the parent well. The method further includes estimating a dimension of the child well fracture when the hydraulic connection was formed using the TFR data and/or the VFR data, in combination with one or more fracture growth profiles, as well as estimating a propped fracture dimension of the parent well fracture based on the estimated dimension of the child well fracture and the distance between the child well and the parent well at the corresponding stage.

Another embodiment described herein provides a hydrocarbon well system including a parent well, a child well, and a computing system. The parent well includes a wellhead and a wellbore extending from the wellhead into a surrounding formation, where the wellbore includes a number of stages that have been hydraulically fractured to generate corresponding parent well fractures within the formation. The child well is within the vicinity of the parent well and includes a wellhead and a wellbore extending from the wellhead into the formation, where the wellbore includes a number of stages that are to be hydraulically fractured to generate a number of child well fractures within the formation. The computing system that is communicably coupled to the parent well and includes a processor and a non-transitory, computer-readable storage medium. The non-transitory, computer-readable storage medium includes program instructions that are executable by the processor to cause the processor to: (a) during the hydraulic fracturing of a stage of the child well to form a corresponding child well fracture, measure, via the parent well, data that are indicative of the formation of a hydraulic connection between the child well and the parent well via an interaction between the wetted front of the child well fracture and the propped region of a corresponding parent well fracture; (b) measure TFR data and/or VFR data corresponding to the formation of the hydraulic connection between the child well and the parent well; (c) estimate a dimension of the child well fracture when the hydraulic connection was formed using the TFR data and/or the VFR data, in combination with one or more fracture growth profiles; and (d) estimate a propped fracture dimension of the parent well fracture based on the estimated dimension of the child well fracture and the distance between the child well and the parent well at the corresponding stage.

Another embodiment described herein provides a non-transitory, computer-readable storage medium, comprising program instructions that are executable by a processor to cause the processor to: (a) measure TFR/distance data and/or VFR/distance data for one or more well pairs including a treatment well and a monitor well; (b) generate one or more fracture growth profiles based on fracture growth shapes for hydraulic fractures in combination with pump rates for hydraulic fracturing; (c) calibrate the fracture growth profile (s) using the TFR/distance data and/or the VFR/distance data; (d) during hydraulic fracturing of a stage of a child well within a hydrocarbon field of interest to form a corresponding child well fracture, measure, via a parent well within the hydrocarbon field of interest, data that are indicative of the formation of a hydraulic connection between the child well and the parent well via an interaction between a wetted front of the child well fracture and the propped region of a corresponding parent well fracture; (e) measure TFR data and/or VFR data corresponding to the formation of the hydraulic connection between the child well and the parent well; (f) estimate a dimension of the child well fracture when the hydraulic connection was formed using the TFR data and/or the VFR data, in combination with the fracture growth profile(s); (g) estimate a propped fracture dimension of the parent well fracture based on the estimated dimension of the child well fracture and the distance between the child well and the parent well at the corresponding stage; (h) repeat the measurement of the data via the parent well, the measurement of the TFR data and/or the VFR data, the estimation of the dimension of the child well fracture, and the estimation of the propped fracture dimension of the parent well fracture for each of a plurality of stages of the child well; and (i) generate a distribution of estimated propped fracture dimensions for the parent well.

These and other features and attributes of the disclosed embodiments of the present techniques and their advantageous applications and/or uses will be apparent from the detailed description that follows.

BRIEF DESCRIPTION OF THE DRAWINGS

To assist those of ordinary skill in the relevant art in making and using the subject matter described herein, reference is made to the appended drawings, where.

Figure 1A:
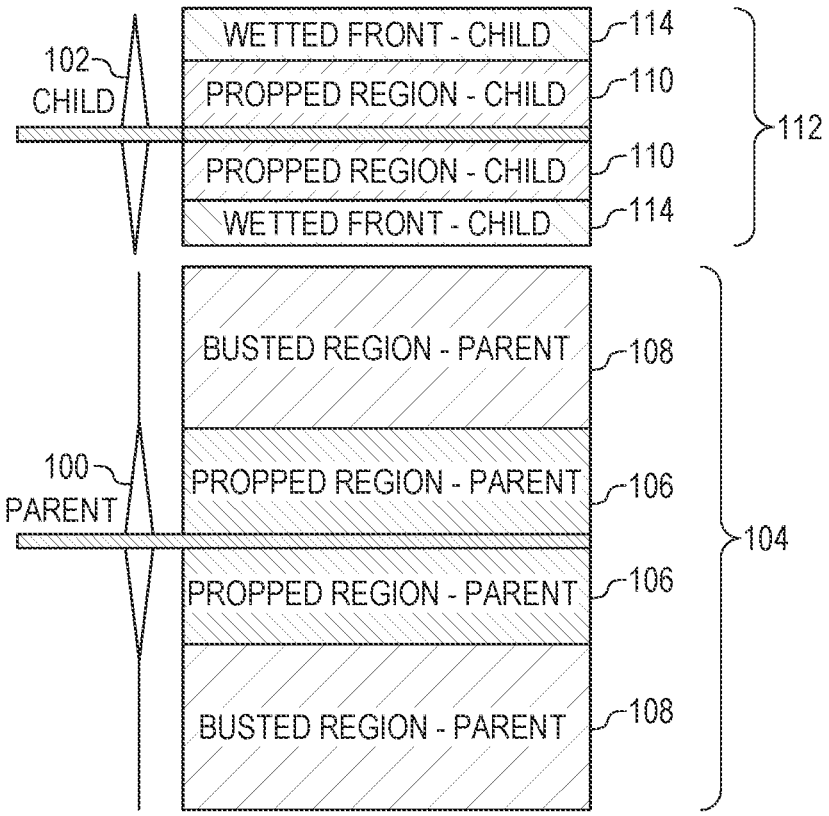
FIG. 1A is a simplified schematic view illustrating a relationship between a parent well fracture and a child well fracture as the child well fracture is initially created in accordance with the present techniques.

It should be noted that the figures are merely examples of the present techniques and are not intended to impose limitations on the scope of the present techniques. Further, the figures are generally not drawn to scale, but are drafted for purposes of convenience and clarity in illustrating various aspects of the techniques.

DETAILED DESCRIPTION OF THE PREFERRED EMBODIMENTS

In the following detailed description section, the specific examples of the present techniques are described in connection with preferred embodiments. However, to the extent that the following description is specific to a particular embodiment or a particular use of the present techniques, this is intended to be for exemplary purposes only and simply provides a description of the embodiments. Accordingly, the techniques are not limited to the specific embodiments described below, but rather, include all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition those skilled in the art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, the singular forms "a," "an," and "the" mean one or more when applied to any embodiment described herein. The use of "a," "an," and/or "the" does not limit the meaning to a single feature unless such a limit is specifically stated.

The term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "including," may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the term "any" means one, some, or all of a specified entity or group of entities, indiscriminately of the quantity.

The phrase "at least one," when used in reference to a list of one or more entities (or elements), should be understood to mean at least one entity selected from any one or more of the entities in the list of entities, but not necessarily including at least one of each and every entity specifically listed within the list of entities, and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently, "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

As used herein, the phrase "based on" does not mean "based only on," unless expressly specified otherwise. In other words, the phrase "based on" means "based only on," "based at least on," and/or "based at least in part on."

As used herein, the term "bench" refers to a target interval or section of a subsurface area that typically shares a substantial number of geologic properties, somewhat analogous to a geological formation.

As used herein, the terms "example," exemplary," and "embodiment," when used with reference to one or more components, features, structures, or methods according to the present techniques, are intended to convey that the described component, feature, structure, or method is an illustrative, non-exclusive example of components, features, structures, or methods according to the present techniques. Thus, the described component, feature, structure, or method is not intended to be limiting, required, or exclusive/exhaustive; and other components, features, structures, or methods, including structurally and/or functionally similar and/or equivalent components, features, structures, or methods, are also within the scope of the present techniques.

As used herein, the term "field" (sometimes referred to as an "oil and gas field" or a "hydrocarbon field") refers to an area including one or more hydrocarbon wells for which hydrocarbon production operations are to be performed to provide for the extraction of hydrocarbon fluids from a corresponding subterranean formation.

The term "fracture" (or "hydraulic fracture") refers to a crack or surface of breakage induced by an applied pressure or stress within a subterranean formation. Moreover, as described above, the term "wetted fracture" (or "wetted region" or "wetted hydraulic fracture") refers to an entire hydraulic fracture, while the term "propped fracture" (or "propped region" or "propped hydraulic fracture") refers to the region of the hydraulic fracture where proppant is present in enough quantity to prevent the closure of the hydraulic fracture. Furthermore, because the propped region of a fracture is the primary region of the fracture that contributes to the production of hydrocarbon fluids, in some cases, such region may also be referred to as the "productive region" and/or the "conductive region" of the fracture. Relatedly, the term "busted region" is used herein to refer to the non-propped region of the fracture that closes once the hydraulic pressure is released (i.e., the wetted region minus the propped region).

The term "hydraulic fracturing" refers to a process for creating fractures (also referred to as "hydraulic fractures") that extend from a wellbore into a reservoir, so as to stimulate the flow of hydrocarbon fluids from the reservoir into the wellbore. A fracturing fluid is generally injected into the reservoir with sufficient pressure to create and extend multiple fractures within the reservoir, and a proppant material is used to "prop" or hold open the fractures after the hydraulic pressure used to generate the fractures has been released.

The term "pressure receiver" is used herein to refer to any suitable type of pressure gauge or other pressure-measuring device that is capable of measuring pressure changes within a wellbore, which may be achieved through measurements taken at the surface and/or at one or more locations within the wellbore itself.

As used herein, the term "surface" refers to the uppermost land surface of a land well, or the mud line of an offshore well, while the term "subsurface" (or "subterranean") generally refers to a geologic strata occurring below the earth's surface. Moreover, as used herein, "surface" and "subsurface" are relative terms. The fact that a particular piece of equipment is described as being on the surface does not necessarily mean it must be physically above the surface of the earth but, rather, describes only the relative placement of the surface and subsurface pieces of equipment. In that sense, the term "surface" may generally refer to any equipment that is located above the casing strings and other equipment that is located inside the wellbore. Moreover, according to embodiments described herein, the terms "downhole" and "subsurface" are sometimes used interchangeably, although the term "downhole" is generally used to refer specifically to the inside of the wellbore.

The term "wellbore" refers to a borehole drilled into a subterranean formation. The borehole may include vertical, deviated, highly deviated, and/or horizontal sections. The term "wellbore" also includes the downhole equipment associated with the borehole, such as the casing strings, production tubing, gas lift valves, and other subsurface equipment. Relatedly, the term "hydrocarbon well" (or simply "well") includes the wellbore in addition to the wellhead and other associated surface equipment.

The term "hydrocarbon well system" is used herein to refer to all the hydrocarbon wells and associated equipment within a particular field of interest. More specifically, according to embodiments described herein, a hydrocarbon well system includes at least one parent well (with the corresponding wellhead, wellbore, and associated downhole and surface equipment) and at least one child well (with the corresponding wellhead, wellbore, and associated downhole and surface equipment). In addition, according to embodiments described herein, the hydrocarbon well system includes at least one computing system that enables the direction and execution of various hydrocarbon development tasks with respect to any of the wells within the field, including, for example, completion, stimulation, and production-related tasks.

Turning now to details of the present techniques, as described above, techniques have been developed to indirectly estimate wetted fracture dimensions. However, because the propped fracture dimensions are more relevant to future production potential than the overall wetted fracture dimensions, knowledge of the wetted fracture dimensions is not sufficient to predict well performance and/or to guide well spacing, stacking, and/or completion strategies during development planning. Accordingly, the present techniques alleviate this difficulty and provide related advantages as well. In particular, the techniques described herein provide for the determination of propped fracture dimensions for a parent well based on interactions between the parent well and a child well that is in the vicinity of the parent well. More specifically, according to the present techniques, a child well is stimulated to provide for the collection of data for fracture diagnostics, enabling the characterization of the propped regions of the hydraulic fractures corresponding to particular stages of the parent well.

According to the present techniques, during the stimulation of a particular stage of the child well, wetted hydraulic fractures originating from the child well propagate through the formation. When the wetted fronts of the child well fractures interact with the propped regions of the parent well fractures within the corresponding stage of the parent well, one or more hydraulic connections are established between the parent well and the child well. Once the hydraulic connection(s) are formed, fluid flows from high-pressure regions (which generally correspond to the child well) to low-pressure regions (which generally correspond to the parent well), resulting in a measurable pressure increase in the parent well. The elapsed time (referred to as the Time to First Response (TFR)) and/or the volume of fluid injected (referred to as the Volume to First Response (VFR)) to establish the pressure increase (or other type of measurable response, e.g., using cross-well strain data) in the parent well may then be utilized, in combination with one or more fracture growth profiles or models, to establish the propped fracture dimensions for the particular stage of the parent well, as described further herein. This process may then be repeated for every stage of the child well (or at least a portion of such stages) to generate a range of estimated propped fracture dimensions for the parent well. Such information may then be utilized to, for example, aid in the prediction of well performance and/or the development of well spacing, stacking, and/or completion strategies.

Notably, according to the techniques described herein, the parent well and the child well are located in the same field. Moreover, in various embodiments, the parent well and the child well are positioned such that hydraulic fractures originating from a particular stage of the child well are capable of establishing hydraulic connections with hydraulic fractures originating from a corresponding stage of the parent well via propagation of the hydraulic fractures corresponding to the child well through the subsurface region in the direction of the parent well. In particular, in various embodiments, the wetted front of at least one child well fracture is capable of establishing a hydraulic connection with the propped region of at least one parent well fracture. Accordingly, the techniques described herein can be advantageously applied to any subsurface hydraulic fracturing scenarios involving multiple wells that are within relatively close proximity to each other.

Turning now to a detailed description of the drawings, FIG. 1A is a simplified schematic view illustrating a relationship between a parent well fracture 100 and a child well fracture 102 as the child well fracture 102 is initially created in accordance with the present techniques. In particular, as shown in FIG. 1A, the parent well fracture 100 consists of a wetted region 104, which is the entire hydraulic fracture that is generated using fracturing fluid during the hydraulic fracturing process. The parent well fracture 100 also includes a smaller, propped region 106, which is the region of the parent well fracture 100 that includes sufficient proppant to prevent closure upon the release of the hydraulic pressure generated during the hydraulic fracturing process. Furthermore, because the hydraulic fracturing process has already been completed for the parent well fracture 100, the fracture 100 includes a busted region 108 that has already closed.

According to the embodiment shown in FIG. 1A, the propped region 110 and the larger wetted region 112 of the child well fracture 102 are depicted in their early stages as the fracture propagates through the formation during the hydraulic fracturing process. As shown, the child well fracture 102 also includes a wetted front 114 that propagates through the formation as the fracturing fluid creates cracks within the subsurface.

Figure 1B:
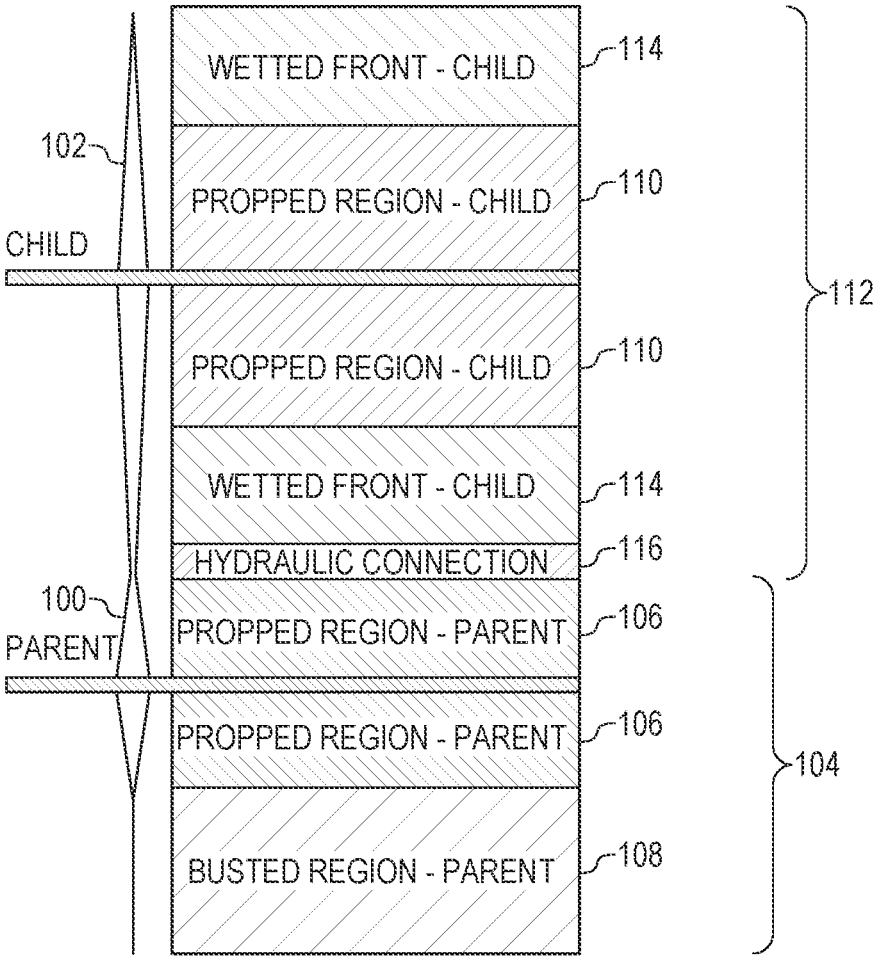
FIG. 1B is a simplified schematic view illustrating the interaction between the parent well fracture and the child well fracture as the child well fracture continues to propagate through the subsurface region, thus forming a hydraulic connection between the two wells in accordance with the present techniques.

FIG. 1B is a simplified schematic view illustrating the interaction between the parent well fracture 100 and the child well fracture 102 as the child well fracture 102 continues to propagate through the subsurface region, thus forming a hydraulic connection 116 between the two wells in accordance with the present techniques. More specifically, the hydraulic connection 116 is formed when the wetted front 114 of the child well fracture 102 grows to the extent of interacting with the propped region 106 of the parent well fracture 100, thus creating a fluid pathway by which the child well fracture 102 begins to lose fluid in the direction of the parent well fracture 100.

Figure 1C:
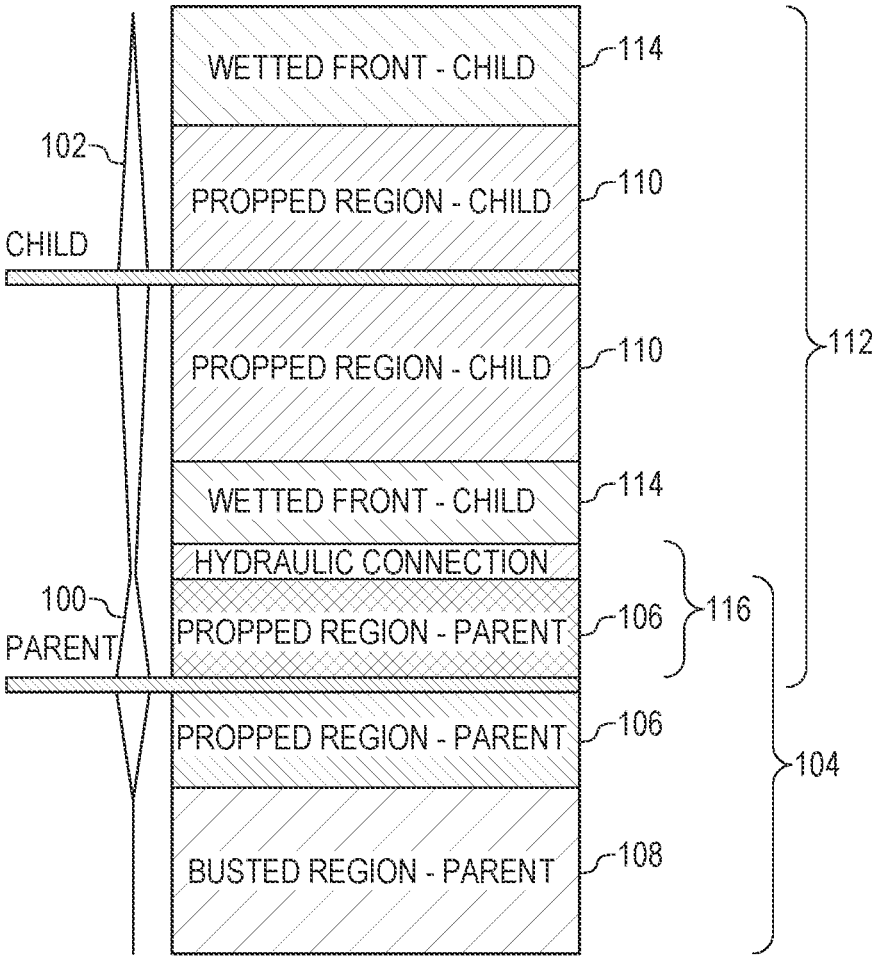
FIG. 1C is a simplified schematic view illustrating the interaction between the parent well fracture and the child well fracture as the child well fracture loses fluid in the direction of the parent well fracture in accordance with the present techniques.

FIG. 1C is a simplified schematic view illustrating the interaction between the parent well fracture 100 and the child well fracture 102 as the child well fracture 102 loses fluid in the direction of the parent well fracture 100 in accordance with the present techniques. As shown in FIG. 1C, as the child well fracture 102 continues to lose fluid in the direction of the parent well fracture 100, the hydraulic connection 116 between the two wells grows as the child well fracture 102 grows asymmetrically in the direction of the parent well fracture 100. As described herein, the fluid loss in the direction of the parent well fracture 100 thus results in measurable parametric changes (i.e., most notably, an increase in pressure) with respect to the parent well. As a result, the established hydraulic connection 116 enables the measurement of fracture diagnostic data that can be used to estimate the dimensions (e.g., the length and/or height) of the propped region 106 of the parent well fracture 100.

Figure 2:
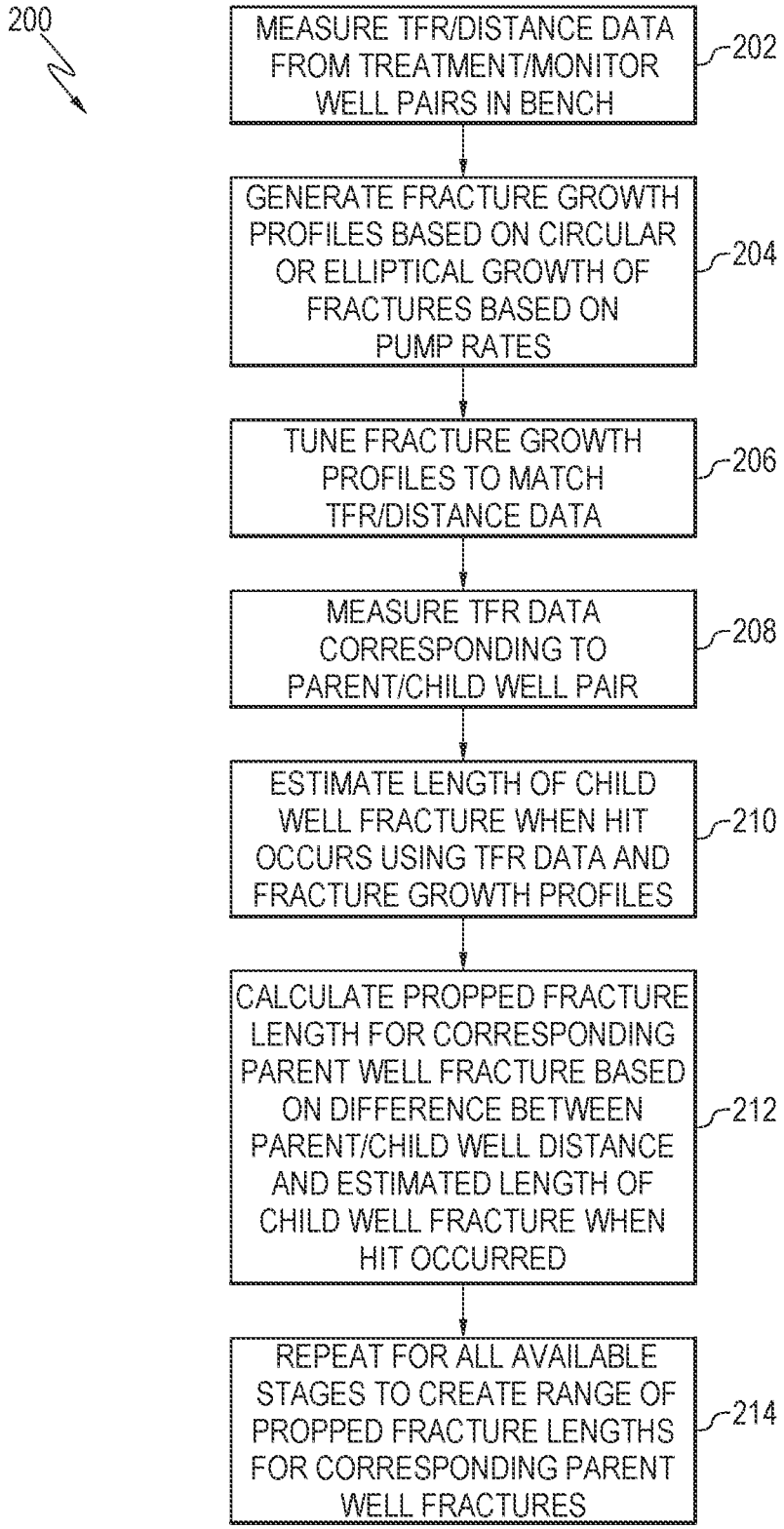
FIG. 2 is a process flow diagram of an exemplary process for propped fracture dimension determination in accordance with the present techniques.

FIG. 2 is a process flow diagram of an exemplary process 200 for propped fracture dimension determination in accordance with the present techniques. The method 200 may be executed, at least in part, by one or more computing systems including one or more processors, such as the exemplary cluster computing system described with respect to FIG. 5 (or any suitable variation(s) thereof). In some embodiments, such computing system(s) are positioned at the field at which the parent well and the child well are located and form part of the overall hydrocarbon well system. For example, the computing system(s) may form part of a mobile command center for directing the operations performed with respect to such wells.

The process 200 begins at block 202, at which fracture diagnostic data representing the time to first response (TFR) versus the distance traveled (referred to herein as "TFR/distance data") are measured from treatment/monitor well pairs within the same bench (or similar benches or general area) as the parent well and child well of interest. However, it should be noted that other types of fracture diagnostic data that are representative of fracture propagation can additionally or alternatively be measured, as long as such data are sufficient to determine the "time to hit" for a range of distances encompassing the distance between the relevant well pair (where the term "hit" is used herein to refer to the point at which an interaction occurs between the two wells). As an example, in some embodiments, data representing the volume to first response (VFR) versus the distance traveled (referred to herein as "VFR/distance data") may be additionally or alternatively utilized. As another example, in some embodiments, cross-well strain (CWS) data may be utilized (additionally or alternatively to pressure data) to measure the response in the monitor well. Furthermore, in some embodiments, at least a portion of the fracture diagnostic data may be measured from other wells in different fields that are similar to the field of interest. Thus, the techniques described herein are not limited to the measurement of data from wells within the same field as the parent well and child well.

At block 204, fracture growth profiles are generated for each well based on the circular and/or elliptical growth of hydraulic fractures within the formation in combination with corresponding pump rates (where the term "pump rate" refers to the rate at which fracturing fluid is pumped into a wellbore during a hydraulic fracturing process). More specifically, the fracture growth profiles are dependent on the pumped volume of fracturing fluid causing the hydraulic fractures to grow, with the growth of each hydraulic fracture being directly correlated to the volume of fracturing fluid that has been pumped at any given point in time.

Figure 3A:
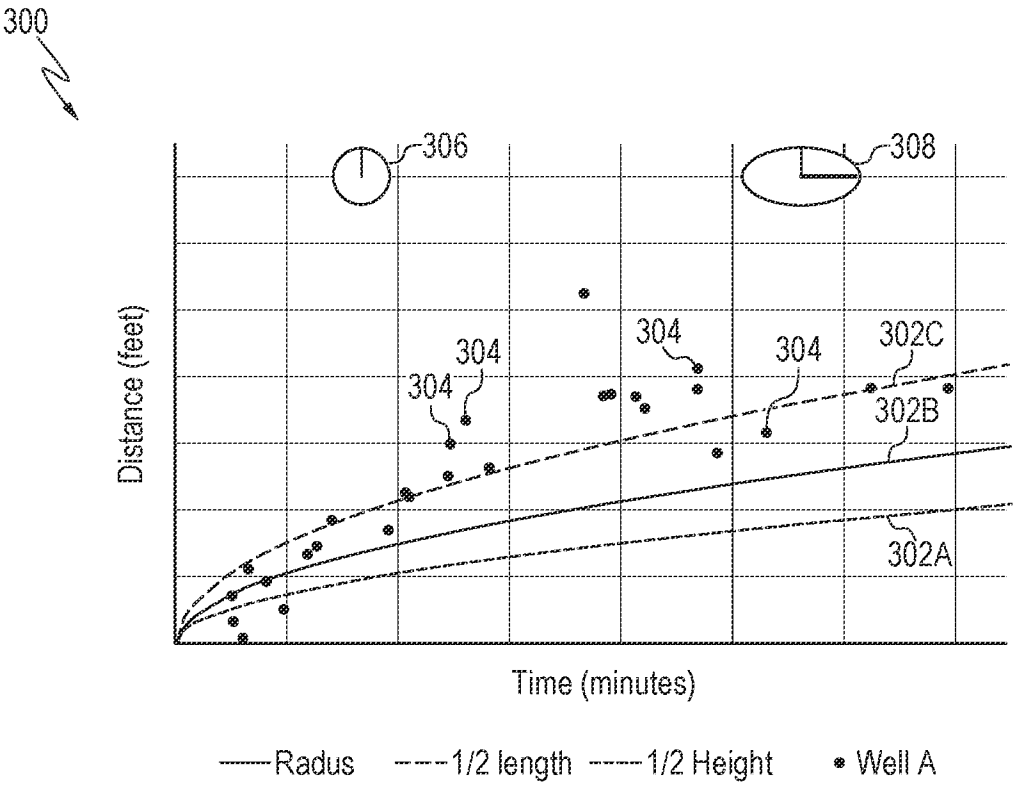
FIG. 3A is a graph illustrating the generation of fracture growth profiles in accordance with the present techniques.

An example of the process described with respect to block 204 is depicted, at least in part, by FIG. 3A, which is a graph 300 illustrating the generation fracture growth profiles 302A, 302B, and 302C in accordance with the present techniques. Specifically, the fracture growth profiles 302A, 302B, and 302C are representative of the velocity with which the hydraulic fractures are growing based on time (in minutes) versus distance (in feet). Moreover, the data points 304 shown in the graph 300 are representative of the TFR/distance data measured with respect to block 202.

The example shown in FIG. 3A provides a circular fracture growth shape 306 and an elliptical fracture growth shape 308. However, any other suitable fracture growth shape can be additionally or alternatively employed, as long as the fracture growth shape can be accurately described mathematically. Furthermore, in some embodiments, a fracture simulation could be employed to predict the length/height ratios for the hydraulic fractures.

Additionally or alternatively, in some embodiments, one or more fracture models may be utilized to predict or estimate the fracture growth profiles described herein. For example, forward modeling techniques and/or machine learning techniques may be utilized, in conjunction with fracture diagnostic data, to generate high-fidelity fracture growth profiles according to embodiments described herein.

At block 206, the generated fracture growth profiles are tuned or calibrated to match the measured TFR/distance data from block 202. In particular, the fracture growth profiles are calibrated according to a curve fitting approach such that the lateral growth of the circular or elliptical fracture growth shape, for example, approximately matches the measured TFR/distance data (or other suitable fracture diagnostic data, depending on the details of the particular implementation). As shown in FIG. 3A, the resulting final fracture growth profiles 302A, 302B, and 302C output from this calibration process are closely matched to the TFR/distance data points 304.

At block 208, TFR data are measured with respect to a particular stage of a child well including hydraulic fractures that are growing in the direction of a corresponding stage of a parent well. In particular, as the stage of the child well is being fractured, pressure data (or, in alternative embodiments, CWS data) are measured with respect to the parent well. For embodiments in which pressure data are utilized, this may be accomplished using one or more pressure receivers (or one or more arrays of pressure receivers) that are hydraulically coupled to the parent wellbore and are positioned downhole and/or at the surface (e.g., at the wellhead of the parent well). For embodiments in which CWS data are utilized, this may be accomplished using a fiber optic cable that is deployed within the wellbore (or otherwise positioned such that it is capable of measuring the desired CWS data). Moreover, for embodiments in which TFR data are utilized, the elapsed time from when the hydraulic fracturing of the stage of the child well began to the time when the hit occurred (i.e., the moment when the hydraulic connection was formed with the parent well), as determined by the pressure response (or CSW response) measured with respect to the parent well, is recorded as the TFR.

Figure 3B:
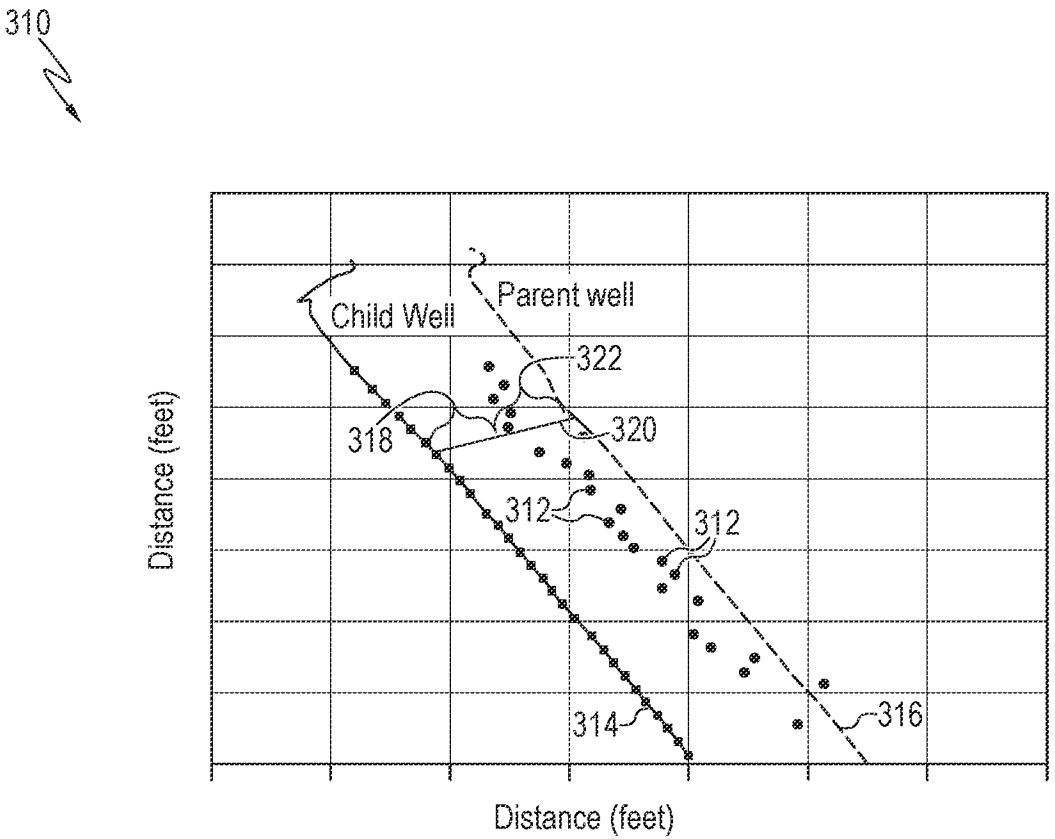
FIG. 3B is a graph illustrating the determination of the propped fracture length for a hydraulic fracture corresponding to the parent well in accordance with the present techniques 2.

At block 210, the measured TFR data from block 208 and the tuned fracture growth profiles from block 206 are utilized to estimate the length of the child well fracture when the hit occurred (e.g., as measured along the azimuth of the child well fracture in the direction of the parent well). This process is depicted, at least in part, by FIG. 3B, which is a graph 310 illustrating the determination of the propped fracture length for a particular stage of the parent well in accordance with the present techniques. Specifically, as shown in FIG. 3B, the TFR data (in combination with the fracture growth profiles) for each stage are plotted as TFR data points 312 on the graph 310, where such TFR data points 312 represent the locations of interaction (i.e., interaction points) between the wetted fronts of the child well fractures with the propped regions of the corresponding parent well fractures. In addition, the child well and the parent well are recorded as curves 314 and 316, respectively, on the graph 310, with the distance between the curves 314 and 316 being representative of the physical distance between the two wells. Moreover, taking a single stage as an example, the fracture growth profiles from block 206 are utilized, in combination with the graph 310 and the corresponding TFR data point 312 for the particular stage, to determine the length 318 of the child well fracture (in the direction of the parent well fracture) when the hit occurred.

At block 212, the estimated propped fracture length for the parent well fracture is calculated based on the difference between the total distance between the parent well and the child well and the estimated length of the child well fracture from block 210. In other words, taking the example shown in FIG. 3B, the estimated length 318 of the child well fracture from block 210 is subtracted from the total distance 320 between the two wells for the corresponding stage, resulting in the estimation of the propped fracture length 322 for the parent well fracture within that stage.

Figure 3C:
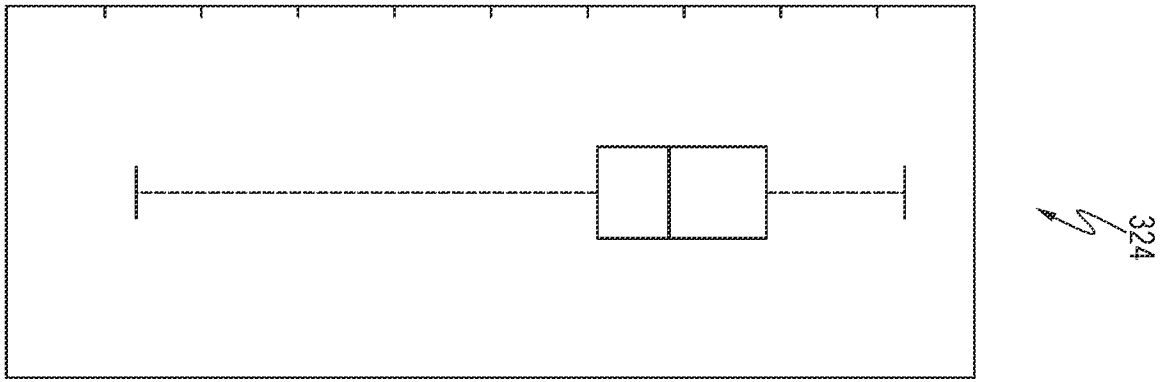
FIG. 3C is a box and whisker chart illustrating an exemplary range of estimated propped fracture lengths for the stages of the parent well in accordance with the present techniques.

At block 214, the process described with respect to blocks 208, 210, and 212 is repeated for all available stages of the child well to create a range of estimated propped fracture lengths for the parent well fractures. Exemplary results of this process are depicted with respect to FIG. 3C, which is a box and whisker chart 324 illustrating an exemplary range of estimated propped fracture lengths for the stages of the parent well in accordance with the present techniques.

According to embodiments described herein, the obtained data can be used to create a distribution of propped fracture lengths for the parent well. If the treatment intensities for the parent well and the child well are the same (or substantially similar), this distribution can also be used for other child wells in the same bench (or similar benches or general area). Moreover, the distribution can be used to develop and execute an appropriate well spacing/stacking plan for the overall field. This may include, for example, advantageously minimizing the number of wells to be drilled within the field to avoid unnecessarily high costs, as well as preventing the under-development of the field, which often results in stranded resources. The propped fracture dimensions may also be used to, for example, adjust the hydraulic fracturing process for wells within the field. This may include, for example, ensuring that the treatment schedules are customized based on the expected propped fracture dimensions.

Furthermore, in some embodiments, if there are differences in the treatment schedules for the wells, a properly-calibrated fracture simulation or fracture model can be used to estimate or predict the differences in the propped fracture lengths. In particular, the fracture model can be calibrated on the parent well using the estimated propped fracture lengths for the parent well (as output from the process 200), and the propped fracture heights can be calibrated using time-lapse geochemistry techniques and/or any other suitable fracture diagnostics techniques. The resulting calibrated fracture model can then be used on any future wells that are developed in the same bench (or similar benches), thus enabling the estimation of propped fracture dimensions for such wells.

Those skilled in the art will appreciate that the exemplary process 200 of FIG. 2 is susceptible to modification without altering the technical effect provided by the present techniques. In practice, the exact manner in which the process 200 is implemented will depend, at least in part, on the details of the specific implementation. For example, in some embodiments, some of the blocks shown in FIG. 2 may be altered or omitted from the process 200 and/or new blocks may be added to the process 200, without departing from the scope of the present techniques. For example, while the process 200 is described with respect to the determination of the propped fracture lengths for the parent well, in some embodiments, the propped fracture heights (and/or any other suitable type of fracture dimension) may additionally or alternatively be determined. In particular, the specific dimension that is being measured may be prescribed by the location of the wellbores and the fracture azimuth, which will vary depending on the details of the specific implementation. Thus, height and length may be considered as two special cases where the wells are either horizontally or vertically aligned. Furthermore, it should be noted that the process 200 described herein may be executed during the hydraulic fracturing process (i.e., during treatment) or after the hydraulic fracturing process has ended (e.g., during a data analysis stage), depending on the details of the particular implementation.

Figure 4:
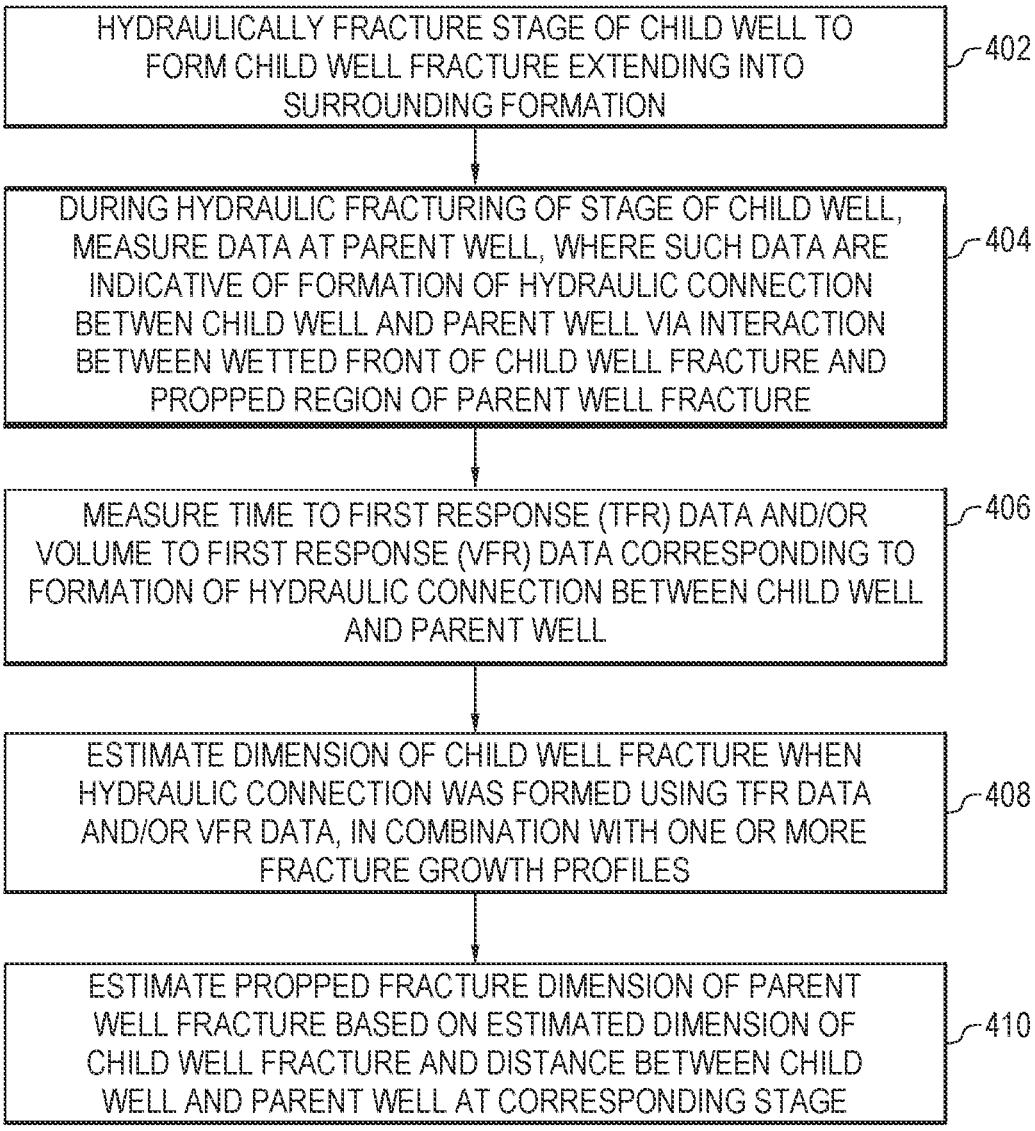
FIG. 4 is a process flow diagram of an exemplary method for propped fracture dimension determination based on parent/child well interactions in accordance with the present techniques.

FIG. 4 is a schematic view of an exemplary method 400 for propped fracture dimension determination based on parent/child well interactions. The method 400 may be executed, at least in part, by one or more computing systems including one or more processors, such as the exemplary cluster computing system described with respect to FIG. 5 (or any suitable variation(s) thereof). In some embodiments, such computing system(s) are positioned at the hydrocarbon field at which the parent well and the child well are located and form part of the overall hydrocarbon well system. For example, the computing system(s) may form part of a mobile command center for directing the operations performed with respect to such wells.

Furthermore, it should be noted that the method 400 corresponds, at least in part, to the process 200 of FIG. 2, with the process 200 of FIG. 2 providing a more detailed, exemplary embodiment of the techniques described herein. As a result, any of the details described with respect to the process 200 of FIG. 2 may be equally applied to the method 400, depending on the particular implementation.

The method 400 begins at block 402, at which a stage of a child well is hydraulically fractured to form a child well fracture extending into a surrounding formation. At block 404, during the hydraulic fracturing of the stage of the child well, data are measured via the parent well, where such data are indicative of the formation of a hydraulic connection between the child well and the parent well via an interaction between the wetted front of the child well fracture and the propped region of a corresponding parent well fracture. In various embodiments, this includes measuring pressure data and/or cross-well strain (CWS) data at the parent well. In such embodiments, the pressure data and/or the CWS data are measured using one or more pressure receivers and/or one or more fiber optic cables, respectively. In that regard, the method 400 may further include hydraulically coupling one or more pressure receivers to the wellbore of the parent well to provide for the measurement of the pressure data and/or deploying one or more fiber optic cables within the wellbore of the parent well to provide for the measurement of the CWS data. Moreover, in various embodiments, such pressure data and/or CWS data (and/or other suitable type of data) are measured repeatedly throughout the hydraulic fracturing process.

At block 406, TFR data and/or VFR data are measured, where such data correspond to the formation of the hydraulic connection between the child well and the parent well via the interaction between the wetted front of the child well fracture and the propped region of the corresponding parent well fracture. In other words, the TFR data and/or the VFR data represent fracture diagnostic data that relate to the time/volume at which the hit occurred between the two fractures, which can be determined, at least in part, by analyzing the data from block 404 (e.g., the pressure data and/or the CWS data).

At block 408, one or more dimensions (e.g., length and/or height) of the child well fracture at the time when the hydraulic connection was initially formed are estimated using the TFR data and/or the VFR data, in combination with one or more fracture growth profiles. In various embodiments, the dimension(s) are estimated based on the location of the wellbores as well as the fracture azimuth. In particular, the dimension(s) may be measured along the azimuth of the child well fracture in the direction of the parent well. Therefore, as described above, height and length may be considered as two special, non-limiting cases where the wells are either horizontally or vertically aligned.

In various embodiments, the fracture growth profile(s) may be generated for each well based on the circular and/or elliptical growth of hydraulic fractures within the formation in combination with corresponding pump rates, as described with respect to FIG. 2. Moreover, in some embodiments, such fracture growth profile(s) may be generated based on the results of simulation runs and/or based on assumptions regarding the mass balance based growth of geometric objects, for example.

At block 410, one or more propped fracture dimensions (e.g., length and/or height) of the parent well fracture are estimated based on the estimated dimension of the child well fracture and the distance between the child well and the parent well at the corresponding stage. In various embodiments, this includes subtracting the estimated dimension of the child well fracture from the total distance between the child well and the parent well at the corresponding stage. Moreover, in various embodiments, the total distance between the child well and the parent well is determined based, at least in part, on the fracture azimuth and/or stress field.

Those skilled in the art will appreciate that the exemplary method 400 of FIG. 4 is susceptible to modification without altering the technical effect provided by the present techniques. In practice, the exact manner in which the method 400 is implemented will depend, at least in part, on the details of the specific implementation. For example, in some embodiments, some of the blocks shown in FIG. 4 may be altered or omitted from the method 400 and/or new blocks may be added to the method 400, without departing from the scope of the present techniques. As an example, in some embodiments, the method 400 is performed for two or more parent wells that interact with one or more child well fractures from the same treatment of the child well. This would allow for the generation of two fracture growth profiles, e.g., in and between benches, providing a more complex propped shape and, thus, potentially a more accurate final result.

In some embodiments, the method 400 is repeated for each stage of the child well (or for some subset of such stages), and the resulting outputs are used to generate a distribution of estimated propped fracture dimensions for the parent well. In such embodiments, the method 400 may further include generating and executing a well spacing/stacking plan for the hydrocarbon field corresponding to the parent well and the child well based on the generated distribution of estimated propped fracture dimensions for the parent well. This may include, among other tasks, drilling, completing, and/or stimulating various wells within the hydrocarbon field. Additionally or alternatively, in such embodiments, the method 400 may further include generating a fracture model based, at least in part, on the generated distribution of estimated propped fracture dimensions for the parent well, as well as utilizing the generated fracture model to estimate propped fracture dimensions corresponding to one or more other wells within the hydrocarbon field.

In various embodiments, the method 400 includes measuring TFR/distance data and/or VFR/distance data for one or more well pairs, where each well pair includes a treatment well and a monitor well (e.g., as described with respect to block 202 of FIG. 2), generating the fracture growth profile (s) (or some subset thereof) based on a fracture growth shape for hydraulic fractures in combination with pump rates for hydraulic fracturing, and calibrating the fracture growth profile(s) using the TFR/distance data and/or the VFR/distance data. Additionally or alternatively, in various embodiments, the method 400 includes generating the fracture growth profile(s) (or some subset thereof) using one or more fracture models, such as, for example, fracture simulation models.

According to embodiments described herein, the resulting propped fracture dimensions for the parent well (e.g., as output from the process 200 of FIG. 2 and/or the method 400 of FIG. 4) are practically, physically applied to the field of interest to enable the development and execution of an appropriate well spacing/stacking plan for the overall field. This may include, for example, advantageously minimizing the number of wells to be drilled within the field to avoid unnecessarily high costs, as well as preventing the under-development of the field, which often results in stranded resources. The propped fracture dimensions may also be used to, for example, adjust the hydraulic fracturing process for wells within the field. This may include, for example, ensuring that the treatment schedules are customized based on the expected propped fracture dimensions.

Figure 5:
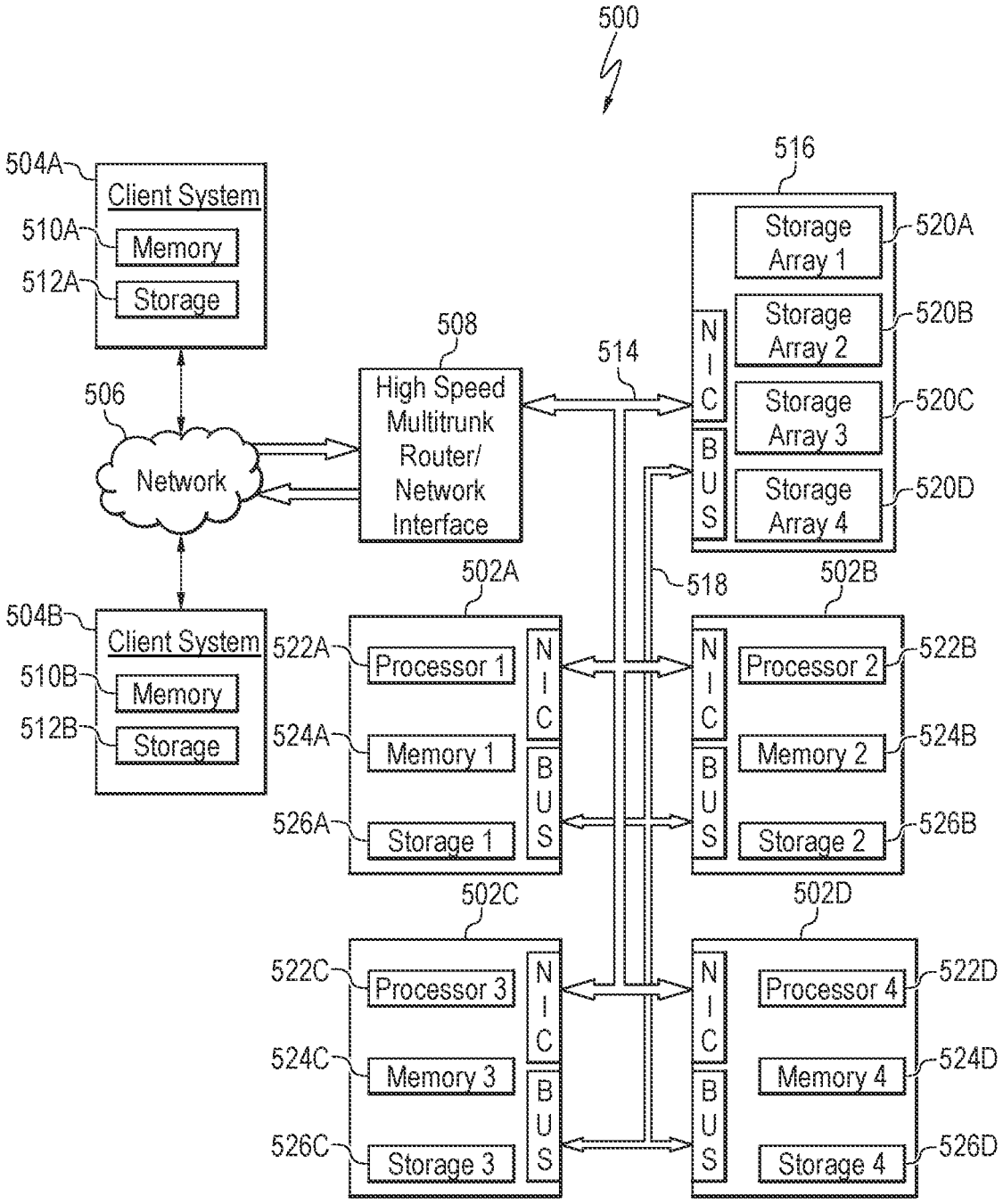
FIG. 5 is a block diagram of an exemplary cluster computing system that may be utilized to implement at least a portion of the present techniques.

FIG. 5 is a block diagram of an exemplary cluster computing system 500 that may be utilized to implement at least a portion of the present techniques. The exemplary cluster computing system 500 shown in FIG. 5 has four computing units 502A, 502B, 502C, and 502D, each of which may perform calculations for a portion of the present techniques. However, one of ordinary skill in the art will recognize that the cluster computing system 500 is not limited to this configuration, as any number of computing configurations may be selected. For example, a smaller analysis may be run on a single computing unit, such as a workstation, while a large calculation may be run on a cluster computing system 500 having tens, hundreds, or even more computing units.

The cluster computing system 500 may be accessed from any number of client systems 504A and 504B over a network 506, for example, through a high-speed network interface 508. The computing units 502A to 502D may also function as client systems, providing both local computing support and access to the wider cluster computing system 500.

The network 506 may include a local area network (LAN), a wide area network (WAN), the Internet, or any combinations thereof. Each client system 504A and 504B may include one or more non-transitory, computer-readable storage media for storing the operating code and program instructions that are used to implement at least a portion of the present techniques, as described further with respect to the non-transitory, computer-readable storage media of FIG. 6. For example, each client system 504A and 504B may include a memory device 510A and 510B, which may include random access memory (RAM), read only memory (ROM), and the like. Each client system 504A and 504B may also include a storage device 512A and 512B, which may include any number of hard drives, optical drives, flash drives, or the like.

The high-speed network interface 508 may be coupled to one or more buses in the cluster computing system 500, such as a communications bus 514. The communication bus 514 may be used to communicate instructions and data from the high-speed network interface 508 to a cluster storage system 516 and to each of the computing units 502A to 502D in the cluster computing system 500. The communications bus 514 may also be used for communications among the computing units 502A to 502D and the cluster storage system 516. In addition to the communications bus 514, a high-speed bus 518 can be present to increase the communications rate between the computing units 502A to 502D and/or the cluster storage system 516.

In some embodiments, the one or more non-transitory, computer-readable storage media of the cluster storage system 516 include storage arrays 520A, 520B, 520C and 520D for the storage of models, data. visual representations, results (such as graphs, charts, and the like used to convey results obtained using the present techniques), code, and other information concerning the implementation of at least a portion of the present techniques. The storage arrays 520A to 520D may include any combinations of hard drives, optical drives, flash drives, or the like.

Each computing unit 502A to 502D includes at least one processor 522A, 522B, 522C and 522D and associated local non-transitory, computer-readable storage media, such as a memory device 524A, 524B, 524C and 524D and a storage device 526A, 526B, 526C and 526D, for example. Each processor 522A to 522D may be a multiple core unit, such as a multiple core central processing unit (CPU) or a graphics processing unit (GPU). Each memory device 524A to 524D may include ROM and/or RAM used to store program instructions for directing the corresponding processor 522A to 522D to implement at least a portion of the present techniques. Each storage device 526A to 526D may include one or more hard drives, optical drives, flash drives, or the like. In addition, each storage device 526A to 526D may be used to provide storage for models, intermediate results, data, images, or code used to implement at least a portion of the present techniques.

The present techniques are not limited to the architecture or unit configuration illustrated in FIG. 5. For example, any suitable processor-based device may be utilized for implementing at least a portion of the embodiments described herein, including (without limitation) personal computers, laptop computers, computer workstations, mobile devices, and multi-processor servers or workstations with (or without) shared memory. Moreover, the embodiments described herein may be implemented, at least in part, on application specific integrated circuits (ASICs) or very-large-scale integrated (VLSI) circuits. In fact, those skilled in the art may utilize any number of suitable structures capable of executing logical operations according to the embodiments described herein.

Figure 6:
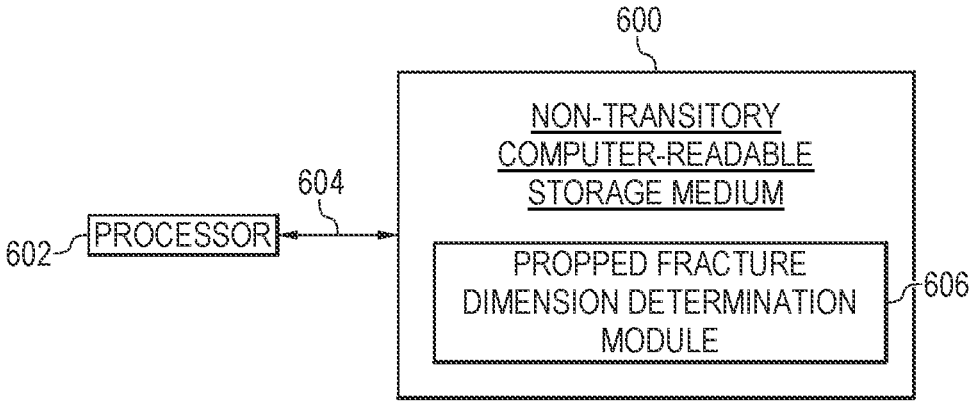
FIG. 6 is a block diagram of an exemplary non-transitory, computer-readable storage medium that may be used for the storage of data and modules of program instructions for implementing at least a portion of the present techniques.

FIG. 6 is a block diagram of an exemplary non-transitory, computer-readable storage medium 600 that may be used for the storage of data and modules of program instructions for implementing at least a portion of the present techniques. The non-transitory, computer-readable storage medium 600 may include a memory device, a hard disk, and/or any number of other devices, as described herein. A processor 602 may access the non-transitory, computer-readable storage medium 600 over a bus or network 604. While the non-transitory, computer-readable storage medium 600 may include any number of modules for implementing the present techniques, in some embodiments, the non-transitory, computer-readable storage medium 600 includes a propped fracture dimension determination module 606 for performing the techniques described herein (and/or any suitable variations thereof).

In one or more embodiments, the present techniques may be susceptible to various modifications and alternative forms, such as the following embodiments as noted in paragraphs 1 to 20:

1. A method for determining propped fracture dimensions for a parent well, including: hydraulic fracturing a stage of a child well to form a child well fracture extending into a surrounding formation; during the hydraulic fracturing of the stage of the child well, measuring, via a parent well, data that are indicative of a formation of a hydraulic connection between the child well and the parent well via an interaction between a wetted front of the child well fracture and a propped region of a corresponding parent well fracture; measuring at least one of time to first response (TFR) data or volume to first response (VFR) data corresponding to the formation of the hydraulic connection between the child well and the parent well; estimating a dimension of the child well fracture when the hydraulic connection was formed using the at least one of the TFR data or the VFR data, in combination with at least one fracture growth profile; and estimating a propped fracture dimension of the parent well fracture based on the estimated dimension of the child well fracture and the distance between the child well and the parent well at the corresponding stage.

2. The method of paragraph 1, including repeating the method for each of a number of stages of the child well; and generating a distribution of estimated propped fracture dimensions for the parent well.

3. The method of paragraph 2, including generating and executing a well spacing/stacking plan for a hydrocarbon field corresponding to the parent well and the child well based on the generated distribution of estimated propped fracture dimensions for the parent well.

4. The method of paragraph 2, including generating a fracture model based, at least in part, on the generated distribution of estimated propped fracture dimensions for the parent well; and utilizing the generated fracture model to estimate propped fracture dimensions corresponding to at least one other well within a hydrocarbon field corresponding to the parent well and the child well.

5. The method of any of paragraphs 1 to 4, including measuring at least one of TFR/distance data or VFR/distance data for at least one well pair comprising a treatment well and a monitor well; generating the at least one fracture growth profile based on a fracture growth shape for hydraulic fractures in combination with pump rates for hydraulic fracturing; and calibrating the at least one fracture growth profile using the at least one of the TFR/distance data or the VFR/distance data.

6. The method of any of paragraphs 1 to 5, including generating the at least one fracture growth profile using a fracture model.

7. The method of any of paragraphs 1 to 6, where the estimated dimension of the child well fracture includes an estimated length of the child well fracture, and where the estimated propped fracture dimension of the parent well fracture includes an estimated propped fracture length of the parent well fracture.

8. The method of any of paragraphs 1 to 7, where the estimated dimension of the child well fracture includes an estimated height of the child well fracture, and where the estimated propped fracture dimension of the parent well fracture includes an estimated propped fracture height of the parent well fracture.

9. The method of any of paragraphs 1 to 8, wherein the data that are measured via the parent well comprise at least one of pressure data or cross-well strain (CWS) data, and wherein the method further includes performing at least one of: hydraulically coupling at least one pressure receiver to a wellbore of the parent well to provide for the measurement of the pressure data; or deploying at least one fiber optic cable within the wellbore of the parent well to provide for the measurement of the CWS data.

10. A hydrocarbon well system, including: a parent well, including a wellhead and a wellbore extending from the wellhead into a formation, where the wellbore includes a number of stages that have been hydraulically fractured to generate a number of parent well fractures within the formation; a child well, where the child well is within a vicinity of the parent well, and where the child well includes a wellhead and a wellbore extending from the wellhead into the formation, where the wellbore includes a number of stages that are to be hydraulically fractured to generate a number of child well fractures within the formation; and a computing system that is communicably coupled to the parent well, where the computing system includes: a processor; and a non-transitory, computer-readable storage medium including program instructions that are executable by the processor to cause the processor to: during the hydraulic fracturing of a stage of the child well to form a corresponding child well fracture, measure, via the parent well, data that are indicative of a formation of a hydraulic connection between the child well and the parent well via an interaction between a wetted front of the child well fracture and a propped region of a corresponding parent well fracture; measure at least one of time to first response (TFR) data or volume to first response (VFR) data corresponding to the formation of the hydraulic connection between the child well and the parent well; estimate a dimension of the child well fracture when the hydraulic connection was formed using the at least one of the TFR data or the VFR data, in combination with at least one fracture growth profile; and estimate a propped fracture dimension of the parent well fracture based on the estimated dimension of the child well fracture and the distance between the child well and the parent well at the corresponding stage.

11. The hydrocarbon well system of paragraph 10, where the non-transitory, computer-readable storage medium includes program instructions that are executable by the processor to cause the processor to: repeat the measurement of the data via the parent well, the measurement of the at least one of the TFR data or the VFR data, the estimation of the dimension of the child well fracture, and the estimation of the propped fracture dimension of the parent well fracture for each of the number of stages of the child well; and generate a distribution of estimated propped fracture dimensions for the parent well.

12. The hydrocarbon well system of paragraph 11, where the non-transitory, computer-readable storage medium includes program instructions that are executable by the processor to cause the processor to generate and execute a well spacing/stacking plan for a hydrocarbon field corresponding to the hydrocarbon well system based on the generated distribution of estimated propped fracture dimensions for the parent well.

13. The hydrocarbon well system of paragraph 11, where the non-transitory, computer-readable storage medium includes program instructions that are executable by the processor to cause the processor to: generate a fracture model based, at least in part, on the generated distribution of estimated propped fracture dimensions for the parent well; and utilize the generated fracture model to estimate propped fracture dimensions corresponding to at least one other well within the hydrocarbon well system.

14. The hydrocarbon well system of any of paragraphs 10 to 13, where the non-transitory, computer-readable storage medium includes program instructions that are executable by the processor to cause the processor to: measure at least one of TFR/distance data or VFR/distance data for at least one well pair comprising a treatment well and a monitor well; generate the at least one fracture growth profile based on a fracture growth shape for hydraulic fractures in combination with pump rates for hydraulic fracturing; and calibrate the at least one fracture growth profile using the at least one of the TFR/distance data or the VFR/distance data.

15. The hydrocarbon well system of any of paragraphs 10 to 14, where the non-transitory, computer-readable storage medium includes program instructions that are executable by the processor to cause the processor to generate the at least one fracture growth profile using a fracture model.

16. The hydrocarbon well system of any of paragraphs 10 to 15, where the estimated dimension of the child well fracture includes an estimated length of the child well fracture, and where the estimated propped fracture dimension of the parent well fracture includes an estimated propped fracture length of the parent well fracture.

17. The hydrocarbon well system of any of paragraphs 10 to 16, where the estimated dimension of the child well fracture includes an estimated height of the child well fracture, and where the estimated propped fracture dimension of the parent well fracture includes an estimated propped fracture height of the parent well fracture.

18. A non-transitory, computer-readable storage medium, including program instructions that are executable by a processor to cause the processor to: measure at least one of TFR/distance data or VFR/distance data for at least one well pair comprising a treatment well and a monitor well; generate at least one fracture growth profile based on a fracture growth shape for hydraulic fractures in combination with pump rates for hydraulic fracturing; calibrate the at least one fracture growth profile using the at least one of the TFR/distance data or the VFR/distance data; during hydraulic fracturing of a stage of a child well within a hydrocarbon field of interest to form a corresponding child well fracture, measure, via a parent well within the hydrocarbon field of interest, data that are indicative of a formation of a hydraulic connection between the child well and the parent well via an interaction between a wetted front of the child well fracture and a propped region of a corresponding parent well fracture; measure at least one of TFR data or VFR data corresponding to the formation of the hydraulic connection between the child well and the parent well; estimate a dimension of the child well fracture when the hydraulic connection was formed using the at least one of the TFR data or the VFR data, in combination with the at least one fracture growth profile; estimate a propped fracture dimension of the parent well fracture based on the estimated dimension of the child well fracture and the distance between the child well and the parent well at the corresponding stage; repeat the measurement of the data via the parent well, the measurement of the at least one of the TFR data or the VFR data, the estimation of the dimension of the child well fracture, and the estimation of the propped fracture dimension of the parent well fracture for each of a number of stages of the child well; and generate a distribution of estimated propped fracture dimensions for the parent well.

19. The non-transitory, computer-readable storage medium of paragraph 18, including program instructions that are executable by the processor to cause the processor to generate and execute a well spacing/stacking plan for the hydrocarbon field of interest based on the generated distribution of estimated propped fracture dimensions for the parent well.

20. The non-transitory, computer-readable storage medium of paragraph 18, including program instructions that are executable by the processor to cause the processor to: generate a fracture model based, at least in part, on the generated distribution of estimated propped fracture dimensions for the parent well; and utilize the generated fracture model to estimate propped fracture dimensions corresponding to at least one other well within the hydrocarbon field of interest.

While the embodiments described herein are well-calculated to achieve the advantages set forth, it will be appreciated that such embodiments are susceptible to modification, variation, and change without departing from the spirit thereof. In other words, the particular embodiments described herein are illustrative only, as the teachings of the present techniques may be modified and practiced in different but equivalent manners apparent to those skilled in the art having the benefit of the teachings herein. Moreover, the systems and methods illustratively disclosed herein may suitably be practiced in the absence of any element that is not specifically disclosed herein and/or any optional element disclosed herein. While compositions and methods are described in terms of "comprising" or "including" various components or steps, the compositions and methods can also "consist essentially of" or "consist of" the various components and steps. Indeed, the present techniques include all alternatives, modifications, and equivalents falling within the true spirit and scope of the appended claims.

What is claimed is:

1. A method for determining propped fracture dimensions for a parent well, comprising:

hydraulic fracturing a stage of a child well to form a child well fracture extending into a surrounding formation;

during the hydraulic fracturing of the stage of the child well, measuring, via a parent well, data that are indicative of a formation of a hydraulic connection between the child well and the parent well via an interaction between a wetted front of the child well fracture and a propped region of a corresponding parent well fracture;

measuring at least one of time to first response (TFR) data or volume to first response (VFR) data corresponding to the formation of the hydraulic connection between the child well and the parent well;

estimating a dimension of the child well fracture when the hydraulic connection was formed using the at least one of the TFR data or the VFR data, in combination with at least one fracture growth profile; and estimating a propped fracture dimension of the parent well fracture based on the estimated dimension of the child well fracture and a distance between the child well and the parent well at the corresponding stage.

2. The method of claim 1, comprising:

repeating the method for each of a plurality of stages of the child well; and generating a distribution of estimated propped fracture dimensions for the parent well.

3. The method of claim 2, comprising generating and executing a well spacing/stacking plan for a hydrocarbon field corresponding to the parent well and the child well based on the generated distribution of estimated propped fracture dimensions for the parent well.

4. The method of claim 2, comprising:

generating a fracture model based, at least in part, on the generated distribution of estimated propped fracture dimensions for the parent well; and utilizing the generated fracture model to estimate propped fracture dimensions corresponding to at least one other well within a hydrocarbon field corresponding to the parent well and the child well.

5. The method of claim 1, comprising:

measuring at least one of TFR/distance data or VFR/distance data for at least one well pair comprising a treatment well and a monitor well;

generating the at least one fracture growth profile based on a fracture growth shape for hydraulic fractures in combination with pump rates for hydraulic fracturing; and calibrating the at least one fracture growth profile using the at least one of the TFR/distance data or the VFR/distance data.

6. The method of claim 1, comprising generating the at least one fracture growth profile using a fracture model.

7. The method of claim 1, wherein the estimated dimension of the child well fracture comprises an estimated length of the child well fracture, and wherein the estimated propped fracture dimension of the parent well fracture comprises an estimated propped fracture length of the parent well fracture.

8. The method of claim 1, wherein the estimated dimension of the child well fracture comprises an estimated height of the child well fracture, and wherein the estimated propped fracture dimension of the parent well fracture comprises an estimated propped fracture height of the parent well fracture.

9. The method of claim 1, wherein the data that are measured via the parent well comprise at least one of pressure data or cross-well strain (CWS) data, and wherein the method further comprises performing at least one of:

hydraulically coupling at least one pressure receiver to a wellbore of the parent well to provide for the measurement of the pressure data; or deploying at least one fiber optic cable within the wellbore of the parent well to provide for the measurement of the CWS data.

* * * * *